US009777906B2

(12) United States Patent
Hikmet et al.

(10) Patent No.: US 9,777,906 B2
(45) Date of Patent: Oct. 3, 2017

(54) LIGHTING UNIT COMPRISING A LAMP SHADE

(71) Applicant: KONINKLIJKE Philips N.V., Eindhoven (NL)

(72) Inventors: Rifat Ata Mustafa Hikmet, Eindhoven (NL); Ties Van Bommel, Horst (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/353,097

(22) PCT Filed: Oct. 16, 2012

(86) PCT No.: PCT/IB2012/055623
§ 371 (c)(1),
(2) Date: Apr. 21, 2014

(87) PCT Pub. No.: WO2013/057656
PCT Pub. Date: Apr. 25, 2013

(65) Prior Publication Data

US 2014/0247579 A1 Sep. 4, 2014

Related U.S. Application Data

(60) Provisional application No. 61/549,297, filed on Oct. 20, 2011.

(51) Int. Cl.
*F21V 9/16* (2006.01)
*F21V 9/08* (2006.01)
(Continued)

(52) U.S. Cl.
CPC ..... *F21V 9/08* (2013.01); *F21K 9/64* (2016.08); *F21V 1/00* (2013.01); *F21V 3/0463* (2013.01);
(Continued)

(58) Field of Classification Search
CPC ..... F21V 9/00
See application file for complete search history.

(56) References Cited

U.S. PATENT DOCUMENTS 5,311,415 A 5/1994 Hyland
7,618,157 B1 * 11/2009 Galvez ..... F21V 3/0481 362/218
(Continued)

FOREIGN PATENT DOCUMENTS

JP 2009086468 A 4/2009
JP 2010530125 A 9/2010
(Continued)

*Primary Examiner* — Evan Dzierzynski

(57) ABSTRACT

The invention provides a lighting unit (1) comprising (a) a light source (10) configured to provide a beam of light (11), the light source (10) having a light exit surface (12) for escape of the light from the light source (10), (b) a lamp shade (20) partly surrounding the light source (10), wherein the lamp shade (20) has an internal lamp shade surface (21) and a lamp shade light exit (22), and (c) a light conversion element (30), configured partly between the light exit surface (12) of the light source (10) and the lamp shade light exit (22) of the lamp shade (20), wherein the light conversion element (30) comprises a light transmissive part (31), wherein the light transmissive part (31) comprises a luminescent material configured (40) to convert at least part of the beam of light into luminescent material light.

17 Claims, 4 Drawing Sheets

(51) Int. Cl.

| | |
|---|---|
| ***F21V 3/04*** | (2006.01) |
| ***F21V 1/00*** | (2006.01) |
| ***F21K 9/64*** | (2016.01) |
| *F21V 13/02* | (2006.01) |
| *F21Y 115/10* | (2016.01) |

(52) U.S. Cl.
CPC ..... *F21V 9/16* (2013.01); *F21V 13/02* (2013.01); *F21Y 2115/10* (2016.08)

(56) References Cited

U.S. PATENT DOCUMENTS

| | | | | |
|---|---|---|---|---|
| 7,703,942 | B2 * | 4/2010 | Narendran et al. | 362/231 |
| 7,972,030 | B2 | 7/2011 | Li | |
| 8,348,456 | B2 * | 1/2013 | Satou et al. | 362/231 |
| 2006/0034084 | A1 | 2/2006 | Matsuura et al. | |
| 2008/0054281 | A1 | 3/2008 | Narendran et al. | |
| 2008/0094829 | A1 * | 4/2008 | Narendran et al. | 362/231 |
| 2008/0218992 | A1 * | 9/2008 | Li | F21V 1/00 362/84 |
| 2009/0141474 | A1 * | 6/2009 | Kolodin | F21V 3/04 362/84 |
| 2009/0243467 | A1 * | 10/2009 | Shimizu et al. | 313/503 |
| 2009/0273918 | A1 * | 11/2009 | Falicoff et al. | 362/84 |
| 2009/0309116 | A1 | 12/2009 | Kato et al. | |
| 2011/0025951 | A1 * | 2/2011 | Jones | 349/70 |
| 2011/0127557 | A1 | 6/2011 | Ramer et al. | |
| 2011/0176091 | A1 | 7/2011 | Boonekamp et al. | |
| 2011/0216523 | A1 * | 9/2011 | Tong | F21V 5/002 362/84 |
| 2011/0233593 | A1 | 9/2011 | Kawagoe et al. | |
| 2012/0133689 | A1 * | 5/2012 | Kwong | 345/690 |
| 2013/0188354 | A1 * | 7/2013 | Shieh | F21V 13/08 362/235 |

FOREIGN PATENT DOCUMENTS

| | | | |
|---|---|---|---|
| JP | 2011040724 | A | 2/2011 |
| WO | 2008052318 | A1 | 5/2008 |
| WO | 2009128008 | A1 | 10/2009 |
| WO | 2011022610 | A1 | 2/2011 |

* cited by examiner

LIGHTING UNIT COMPRISING A LAMP SHADE

FIELD OF THE INVENTION

The invention relates to a lighting unit with a lamp shade and a light conversion element, as well as to the use of such lighting unit.

BACKGROUND OF THE INVENTION

Lighting units with lamp shades are known in the art. U.S. Pat. No. 5,311,415, for instance, describes a universal foldable lamp shade cover which includes a uniformly pleated rectangular sheet of thin, somewhat rigid yet bendable material having a plurality of side-by-side slender elongated panels integrally connected one to another in accordion fashion along a fold line between each panel. The side margins of the pleated sheet are connected to form a somewhat tubular member which is sized, when reduced in circumference at its upper end, to be held in place primarily by a locking tie or clip arrangement which is inter engageable between an aperture formed through a few evenly spaced selected panels adjacent their upper margins and an upper rigid margin of the lamp shade. Other types of lamp shades are known in the art as well.

SUMMARY OF THE INVENTION

In decorative lighting applications it is considered to be desirable to have a luminaire providing homogeneous white light in the far field while inside the luminaire it has a decorative colored appearance in the light on state (i.e. during operation). Prior art solutions do not seem to provide such functions. Hence, it is an aspect of the invention to provide an alternative lighting unit, which preferably further at least partly provides this desired function.

For this purpose we suggest using remote phosphor configurations for producing different colors in the luminaire (herein also indicated as "lighting unit") which may then lead to homogeneous white illumination in the far field.

We suggest using (organic) luminescent materials (including quantum dots) which can give saturated colors. Further, the position of the emission band can be chosen relatively freely. Hence, we suggest using remote luminescent materials (including quantum dots) configurations for producing different colors in the luminaire which then leads to homogeneous white illumination in the far field while inside the luminaire it has a decorative colored appearance. Therefore, in a first aspect the invention provides a lighting unit comprising:

a light source configured to provide a beam of light, the light source having a light exit surface for escape of the light from the light source, a lamp shade partly surrounding the light source, wherein the lamp shade has an internal lamp shade surface and a lamp shade light exit, a light conversion element, configured partly between the light exit surface of the light source and the lamp shade light exit of the lamp shade, thereby receiving part of the beam of light during operation of the lighting unit, wherein the light conversion element comprises a light transmissive part, wherein the light transmissive part comprises a luminescent material configured to convert at least part of the beam of light into luminescent material light.

With such lighting unit or luminaire, it is possible to provide white light, while having color effects within the lamp shade. Hence, the opening (and/or interior) of the lamp shade may appear to be colored (during operation of the lighting unit), while nevertheless white light is provided (in the far field). For instance, the light escaping from the lighting unit when projecting on a wall or a floor at a distance of 1-10 m from the lamp shade opening may be perceived as white light. Alternatively, the lighting unit may be applied to provide colored light (i.e. colored lighting unit light), and the lamp shade opening (and/or interior) may appear to be colored with a color or color regions differing from the color of the light given by the lighting unit in the far field. Herein, the term far field will be understood by a person skilled in the art. For instance, a distance of at least 0.5 m from the lamp shade light exit, such as in the range of 0.5-10 m, like at least 1 m from the lamp shade light exit, such as 1-10 m from the lamp shade light exit. Hence, the light conversion element, in combination with the light source may for instance be used to project one or more of a colored spot, a color pattern, and colored information on the internal lamp shade surface.

The term light source may in principle relate to any light source known in the art. It may be a conventional (tungsten) light bulb, a low pressure mercury lamp, a high pressure mercury lamp, a fluorescent lamp, a LED (light emissive diode). Preferably, the light source is a light source that during operation emits at least light at wavelength selected from the range of 380-450 nm. This light may partially be used by the light conversion element (see below). In a specific embodiment, the light source comprises a solid state LED light source (such as a LED or laser diode). The term "light source" may also relate to a plurality of light sources, such as 2-20 (solid state) LED light sources. The light source has a light escape surface. Referring to conventional light sources such as light bulbs or fluorescent lamps, it may be outer surface of the glass or quartz envelope. For LED's it may for instance be the LED die, or when a resin is applied to the LED die, the outer surface of the resin. In principle, it may also be the terminal end of a fiber. The term escape surface especially relates to that part of the light source, where the light actually leaves or escapes from the light source. The light source is configured to provide a beam of light. This beam of light (thus) exits the light source via the light exit surface.

The term white light herein, is known to the person skilled in the art. It especially relates to light having a correlated color temperature (CCT) between about 2000 and 20000 K, especially 2700-20000 K, for general lighting especially in the range of about 2700 K and 6500 K, and for backlighting purposes especially in the range of about 7000 K and 20000 K, and especially within about 15 SDCM (standard deviation of color matching) from the BBL (black body locus), especially within about 10 SDCM from the BBL, even more especially within about 5 SDCM from the BBL. In an embodiment, the light source may also provide light source light having a correlated color temperature (CCT) between about 5000 and 20000 K, e.g. direct phosphor converted LEDs (blue light emitting diode with thin layer of phosphor for e.g. obtaining of 10.000K. Hence, in a specific embodiment the light source is configured to provide light source light with a correlated color temperature in the range of 5000-20000 K, even more especially in the range of 6000-20000 K, such as 8000-20000 K. An advantage of the relative high color temperature may be that there may be a relative high blue component in the light source light. This blue component may partially be absorbed by the luminescent material and converted into luminescent material light.

Optionally, a separate blue light source (such as a solid state LED) may be included in the light source.

The terms "violet light" or "violet emission" especially relates to light having a wavelength in the range of about 380-440 nm. The terms "blue light" or "blue emission" especially relates to light having a wavelength in the range of about 440-490 nm (including some violet and cyan hues). The terms "green light" or "green emission" especially relate to light having a wavelength in the range of about 490-560 nm. The terms "yellow light" or "yellow emission" especially relate to light having a wavelength in the range of about 560-590 nm. The terms "orange light" or "orange emission" especially relate to light having a wavelength in the range of about 590-620. The terms "red light" or "red emission" especially relate to light having a wavelength in the range of about 620-750 nm. The terms "visible", "visible light" or "visible emission" refer to light having a wavelength in the range of about 380-750 nm.

Herein, the term "lamp shade" is as known in the art and is in general used as in customer/end-user language. For instance, the lamp shade can be defined as any of various protective or ornamental covering used to screen a light source. In a specific embodiment, the lamp shade has a cylindrical or conical shape. In such embodiment, the internal lamp shade surface may also have a cylindrical or conical shape. The lamp shade has a lamp shade light exit, i.e. the opening through which the light escapes from the lamp shade. In this invention, the light that escapes may be a combination of light source light and optionally converted light source light.

The lamp shade partly surrounds the light source. In this way, a spectator may for instance not be hindered by glare. Alternatively or additionally, the lamp shade may have a decorative function. In general, a substantial part, and at least the light exit surface of the light source will be surrounded by the lamp shade.

The lighting unit further comprises a light conversion element. This element is used to convert at least part of the beam of light into luminescent material light. Hence, this element is not used to convert all light source light. Part of the beam of light will remain non-intercepted by the light conversion element; the light conversion element only "intercepts" part of the beam of light. Hence, the light conversion element is configured partly between the light exit surface of the light source and the lamp shade light exit of the lamp shade. In this way, the light conversion element receives part of the beam of light during operation of the lighting unit. In other words, downstream of the light source, and upstream of the lamp shade light exit, the light conversion element, which is placed in such a way, that only part of the beam of light generated by the light source illuminates the light conversion element.

The terms "upstream" and "downstream" relate to an arrangement of items or features relative to the propagation of the light from a light generating means (here the especially the light source), wherein relative to a first position within a beam of light from the light generating means, a second position in the beam of light closer to the light generating means is "upstream", and a third position within the beam of light further away from the light generating means is "downstream".

The light conversion element comprises a light transmissive part. In this way, light source light may penetrate into the light conversion element and converted light may at the other side of the light conversion element escape therefrom. Optionally, also part of the light source light may escape from the other side of the light conversion element. Hence, the term "light transmissive part" is also used to distinguish from elements that completely absorb the light source light, without escape from luminescence light at a part of the transmissive part opposite of the region that is illuminated. The term "transmissive" may relate to "transparent" or to "translucent".

The light transmissive part comprises a luminescent material configured to convert at least part of the beam of light into luminescent material light. The luminescent material may in principle be any luminescent material, that is suitable to absorb at least part of the light source light and is able to convert at least part of the absorbed light source light into luminescence (especially in the visible). Especially, the luminescent material is configured to absorb at least part of the blue part of the visible light spectrum.

Examples of inorganic luminescent material include, for example, cerium (Ce) doped Yttrium Aluminum Garnet (YAG), for instance in a molecular ratio of YAG:Ce of 2.1 or 3.3, or cerium doped Lutetium Aluminum Garnet (LuAG) (such as in a similar molecular ratio). Specific examples of suitable inorganic luminescent material are for instance $Y_3Al_5O_{12}:Ce^{3+}$, $Y_2LuAl_5O_{12}:Ce^{3+}$, $YGdTbAl_5O_{12}:Ce^{3+}$, $Y_{2.5}Lu_{0.5}Al_5O_{12}:Ce^{3+}$, $(Sr,Ba,Ca)_2SiO_4:Eu^{2+}$, $(Sr,Ca,Ba)Si_2O_2N_2:Eu^{2+}$, $(Ca,Sr,Ba)Ga_2S_4:Eu^{2+}$, etc. Other blue light excitable luminescent material may be applied as well.

Alternatively or additionally, the light conversion element comprises embedded organic luminescent materials. Examples of suitable organic luminescent materials include perylene derivatives, for example, BASF Lumogen®: such as F240 (orange), F305 (red), F083 (yellow), F170 (yellow), or combinations of two or more of such luminescent materials. Hence, in an embodiment the luminescent material comprises a perylene luminescent material, such as one or more of the before-mentioned perylene derivatives.

In a specific embodiment, the light conversion element comprises luminescent quantum dots. Such luminescent material has the advantage of tunability of the emission band (dependent upon the particle size, as known in the art). Further, such systems may give saturated luminescence colors. Most known quantum dots with emission in the visible range are based on cadmium selenide (CdSe) with a shell such as cadmium sulfide (CdS) and (or) zinc sulfide (ZnS) shell. Cadmium free quantum dots, such as indium phosphode (InP), and/or copper indium sulfide ($CuInS_2$) and/or silver indium sulfide ($AgInS_2$) can also be used.

In yet another embodiment, the light conversion element comprises embedded micro particulate inorganic luminescent materials. Alternatively or additionally, the light conversion element comprises embedded micro particulate organic luminescent materials. These particles may be embedded in an organic layer (support), such as an organic plate.

Examples of such supports wherein luminescent particles may be embedded in are transmissive organic material support, such as selected from the group consisting of PE (polyethylene), PP (polypropylene), PEN (polyethylene napthalate), PC (polycarbonate), polymethylacrylate (PMA), polymethylmethacrylate (PMMA) (Plexiglas or Perspex), cellulose acetate butyrate (CAB), silicone, polyvinylchloride (PVC), polyethyleneterephthalate (PET), (PETG) (glycol modified polyethyleneterephthalate), PDMS (polydimethylsiloxane), and COC (cyclo olefin copolymer). However, in another embodiment the support may comprise an inorganic material. Preferred inorganic materials are selected from the group consisting of glasses, (fused) quartz, transmissive ceramic materials, and silicones. Especially preferred are PMMA, transparent PVC, or glass as material for the support.

In yet another embodiment, the material of the support itself comprises luminescent species. For instance, a luminescent glass or a luminescent ceramic may also be applied as light conversion element.

As will be clear to a person skilled in the art, embodiments and variants of the light conversion element may be combined. By way of example, quantum dots and micro particulate luminescent material may be embedded in a transparent (PMMA) support.

In order to give further color effects, the light conversion element may comprise additional features. For instance, the light transmission part may comprise a plurality of transmissive regions having different luminescent properties. In this way, different colors may be generated, which may lead to color effects within the light shade. Alternatively or additionally, the light conversion element may comprise a wall, wherein the wall comprises the light transmissive part, and wherein the wall further comprises one or more through holes. The beam of light may in this way also travel through the through hole in addition to generating luminescence in the light transmissive parts comprising luminescent material.

The light conversion element may have any shape. In an embodiment, it has the shape of a collimator, and may (further) assist in collimating the beam of light of the light source. In yet another embodiment, the light conversion element has the shape of a cylinder or has the shape of a cone. In a specific embodiment, the light conversion element has a hollow shape having a body axis, wherein the beam of light has an optical axis, wherein the body axis and optical axis coincide. In this way, the light conversion element may optionally also be used to shape the beam of light of the light source. In yet a further embodiment, the light conversion element has a similar shape as the lamp shade (for instance a conical lamp shade and a conical light conversion element), although this is not necessarily the case.

The light conversion element is arranged remote from the light source. Hence, the light conversion element is especially not in physical contact with the light exit surface of the light source.

In an embodiment, the light conversion element may be detachably attached to the lighting unit. For instance, the light conversion element may be attached with one or more connectors, such as one or more screws, with one or more snap-on/snap-off means, a Velcro type of attachment, or may be attached via magnetic means. The term "detachably attached" or "detachable" may especially relate to the possibility of a relatively easy exchange (by an end-user) of the light conversion element by another light conversion element, without the necessity to repair and/or to use glue type materials. This function may allow easy exchange in case of damage, but may especially be used to exchange the light conversion element with another light conversion element configured to provide another pattern within the lamp shade and/or another type of color of the far field light.

Hence, in a further embodiment, the invention provides a combination of a lighting unit comprising:

- a light source configured to provide a beam of light, the light source having a light exit surface for escape of the light from the light source,
- a lamp shade partly surrounding the light source, wherein the lamp shade has an internal lamp shade surface and a lamp shade light exit, and
- a plurality of light conversion elements, wherein each light conversion element can be detachably attached to the lighting unit partly between the light exit surface of the light source and the lamp shade light exit of the lamp shade, thereby receiving part of the beam of light during operation of the lighting unit, wherein each light conversion element comprises a light transmissive part, and wherein the light transmissive part comprises a luminescent material configured to convert at least part of the beam of light into luminescent material light. Especially, the plurality of light conversion elements contain at least two different light conversion elements, for instance with (a) different numbers and/or placed through holes, and/or with (b) different numbers and/or places light transmissive part(s).

The lighting unit as defined above may especially be used for providing white lighting unit light escaping from the lamp shade light exit while creating a colored appearance within the lamp shade. In a further embodiment, the lighting unit may be used for providing white lighting unit light escaping from the lamp shade light exit while creating a colored appearance within the lamp shade with different colored regions.

The term "substantially" herein, such as in "substantially all emission" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of".

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Furthermore, some of the features can form the basis for one or more divisional applications.

BRIEF DESCRIPTION OF THE DRAWINGS

Embodiments of the invention will now be described, by way of example only, with reference to the accompanying schematic drawings in which corresponding reference symbols indicate corresponding parts, and in which.

The drawings are not necessarily on scale

DETAILED DESCRIPTION OF THE EMBODIMENTS

Figure 1A:
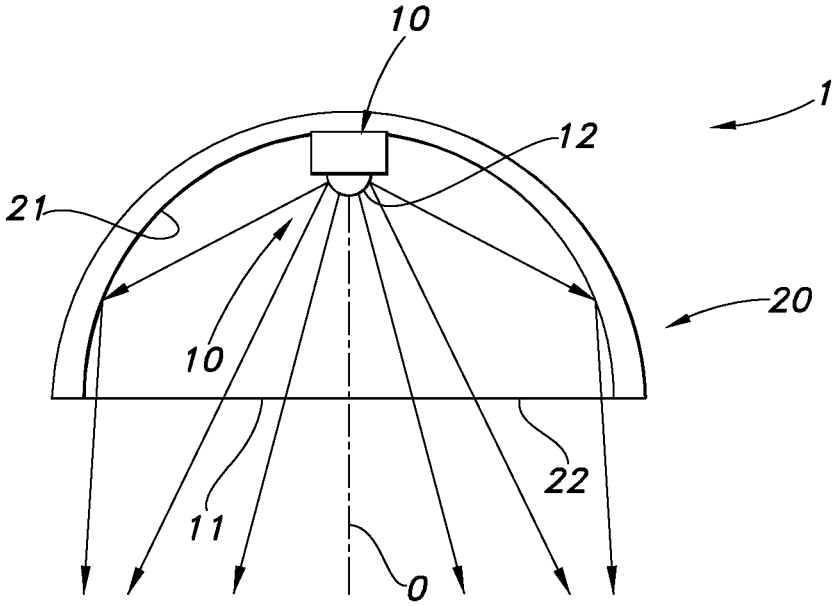
FIGS. 1*a*-1*j* schematically depict some embodiments and aspects of the lighting unit as described herein.

FIG. 1*a* schematically depicts a lighting unit 1 comprising a light source 10 configured to provide a beam of light 11. The light source 10 has a light exit surface 12 for escape of the light from the light source 10, in this case the surface of the resin on a LED. Other configuration are possible as well, such as a shaped diffuser positioned at the vicinity or remote configurations from the light source 10 or a plurality of light sources (e.g. several LEDs). Further, the lighting unit comprises a lamp shade 20 partly surrounding the light source 10. The lamp shade 20 has an internal lamp shade surface 21 and a lamp shade light exit (22). Reference O indicates the optical axis of the beam of light 11 generated by the light source 10 during operation of the lighting unit 1.

Figure 1B:
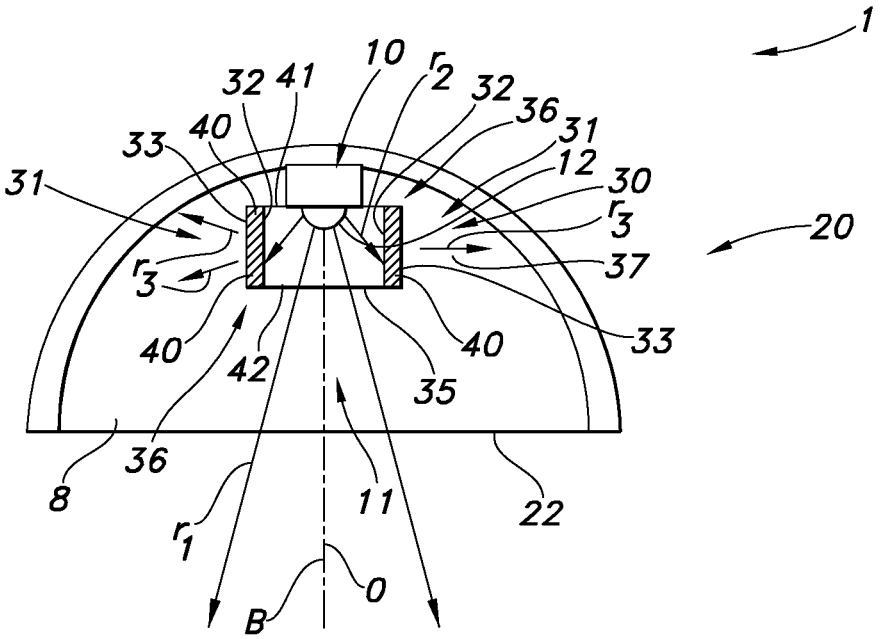

FIG. 1*b* schematically depicts the same lighting unit, now provided with a light conversion element 30. The light conversion element 30 in the schematically depicted embodiments also partly surrounds the light exit surface 12 of the light source 10.

The light conversion element 30 is arranged partly between the light exit surface 12 of the light source 10 and the lamp shade light exit 22 of the lamp shade 20. In this way, it receives part of the beam of light 11 during operation of the lighting unit 1. This is indicated by the rays r1 and r2, wherein the former travels undisturbed, and whereas the latter illuminates the internal surface of the light conversion element 30. As indicated above, the light conversion element 30 comprises a light transmissive part 31 which comprises a luminescent material 40 configured to convert at least part of the beam of light 11 into luminescent material light, indicated with reference 37.

In most of the schematically depicted embodiment, the light conversion element has a wall 36, which has a first surface 32, directed to the light source 10 (or light exit surface 12 of the light source 10) and a second surface 33, opposite first surface, and facing away of the light source 10, but facing the internal lamp shade surface 21. Light source light 11 illuminates the first surface 32 and luminescent light (i.e. luminescent material light 37) may escape from the opposite second surface 33. A ray responsible for excitation of the luminescent material is indicated with reference r2; the luminescent material light 37 is by way of example further indicated with r3; a ray not being "hindered" by the light conversion element 30 is indicated with reference r1. For instance, the light source light may be white light 11 may be white light, with a blue component, that may be converted by the luminescent material 40.

The light conversion element 30 may have a first opening 41, and a second opening 42, through which part of the light source light enters and exits the light conversion element, respectively. The wall 36 may for instance form a cylindrical or spherical hollow element, through the light source light 11 may travel. The light conversion element 30 may have a body axis be, which may be aligned parallel, or preferably coincide, with the optical axis of the light source 10. The optical axis is indicated with reference O.

Figure 1C:
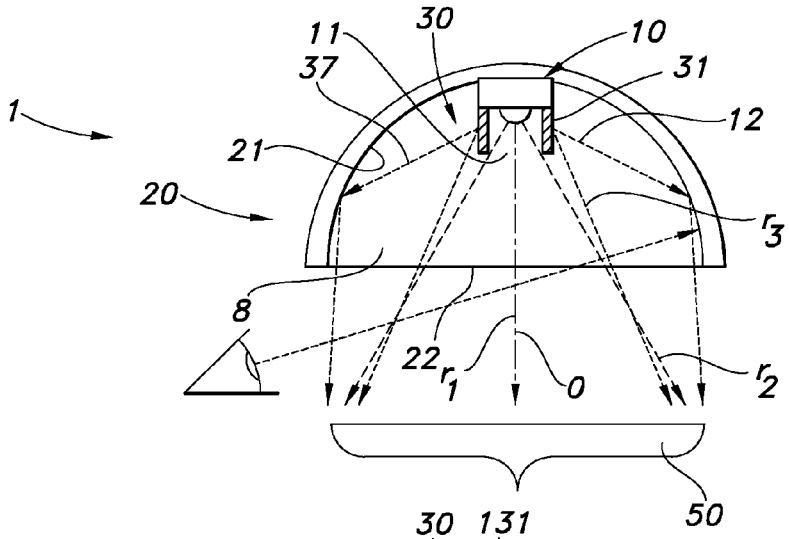

FIG. 1*c* schematically depicts the same embodiment as schematically depicted in FIG. 1*b*, but now with some more details. By way of example, the interior of the lamp shade 20, indicated with reference 8, may have a colored appearance to an observer, whereas the lighting unit light, indicated with reference 50, may appear white. The lighting unit light is the sum of the light source light 11 downstream of the light conversion element 30 and luminescence material light. Here, the light conversion element 30 has the shape of a cylinder.

Figure 1D:
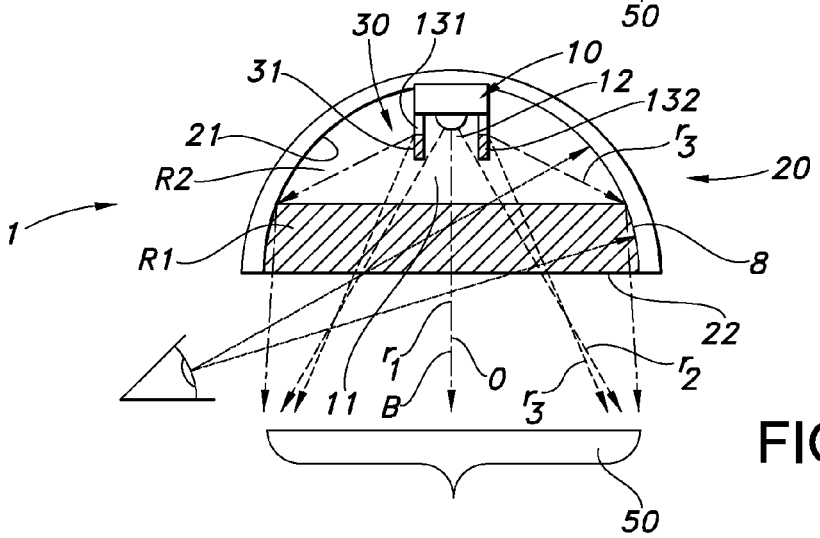
Figure 1E:
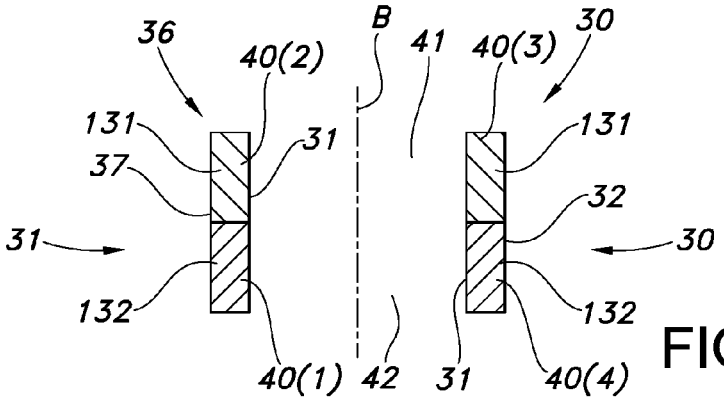

FIG. 1*d* schematically depicts the same embodiment as schematically depicted in FIGS. 1*b* & 1*c*, but now the light conversion element 30 comprises a plurality of transmissive regions, indicated with reference 131, 132, . . . , wherein two or more transmissive regions have different luminescent properties, for instance because of the use of different luminescent materials or different combinations of luminescent materials. This may lead to differently colored regions, as indicated with refs R1 and R2. FIG. 1*e* in detail depicts an embodiment of such light conversion element 30, with different transmissive regions 131, 132 . . . some of them may comprise different types of luminescent materials of different combinations of luminescent materials, which is indicated with references 40(1), 40(2) . . . etc.

Figure 1F:
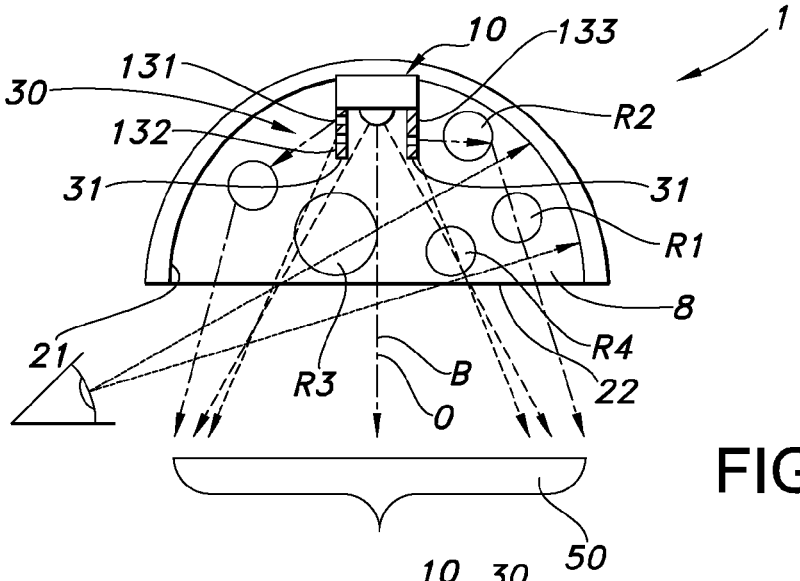
Figure 1G:
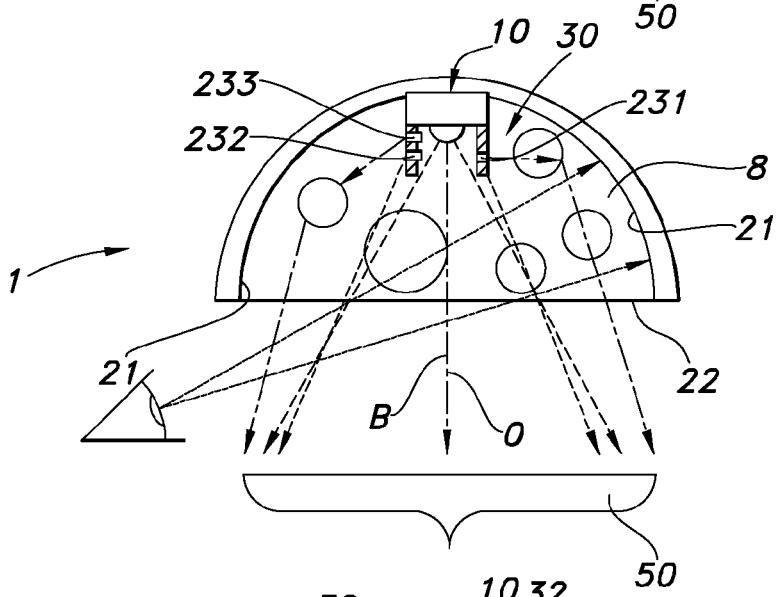

In principle, also a patterned light conversion element 30 may be applied. This may give specific patterns, or even logo's, on the lamp shade internal surface 21. This is schematically depicted in FIG. 1*f*. R1_R4 by way of example indicate differently colored regions. Alternatively or additionally, the light conversion element 30 may also comprise one or more through holes. FIG. 1*g* schematically depicts such light conversion element 30, comprising a plurality of through holes 231, 232, . . . etc.

Figure 1H:
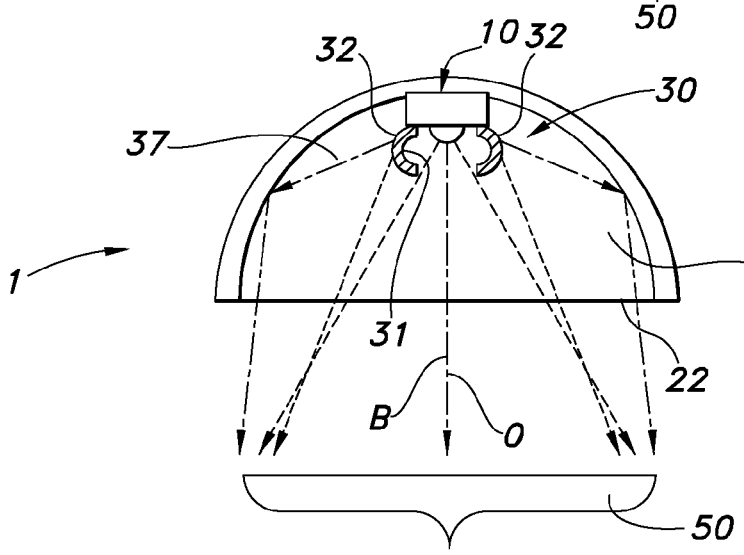
Figure 1I:
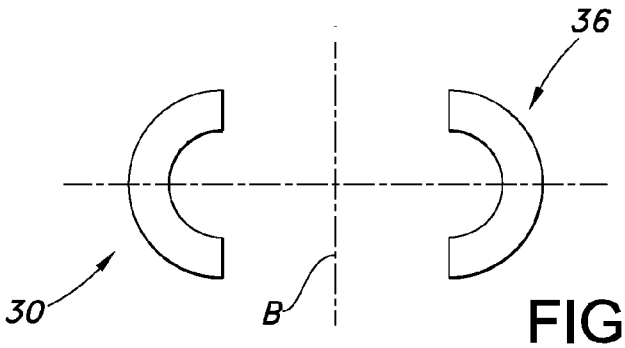

FIGS. 1*h* and 1*i* schematically depict another embodiment of the light conversion element 30. Here, the element is curved around the body axis B and also around an axis perpendicular to the body axis B. FIG. 1*h* is added to show that all kind of shapes of the light conversion element 30 may be applied.

Figure 1J:
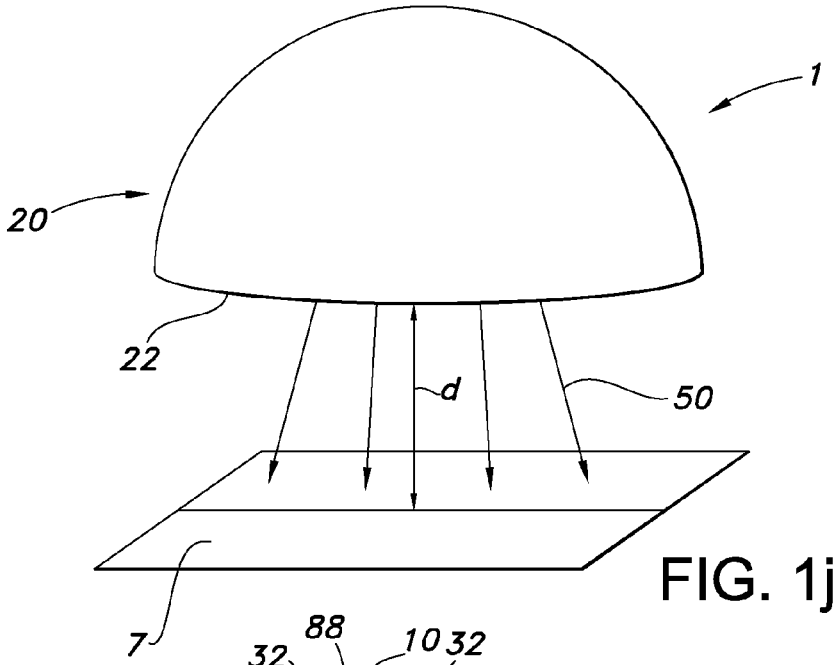

FIG. 1*j* schematically depicts that in the far field another type of light may be obtained than within the lamp shade 20. An object 7, such as a floor, or a wall, at a distance d from the lamp shade light exit 22 may receive white light. In other words, an observer may observe the object 7 to be illuminated with lighting unit light 50, notwithstanding the fact that the lamp shade interior may appear to be colored by colored light (not depicted in this drawing, but see FIGS. 1*c*-1*d* and 1*f*-1*h*. For instance, a distance d of at least 0.5 m from the lamp shade light exit, the lighting unit light 50 illuminating an object may be perceived white (or having a different color than the color(s) of the light within the lamp shade 20).

Figure 1K:
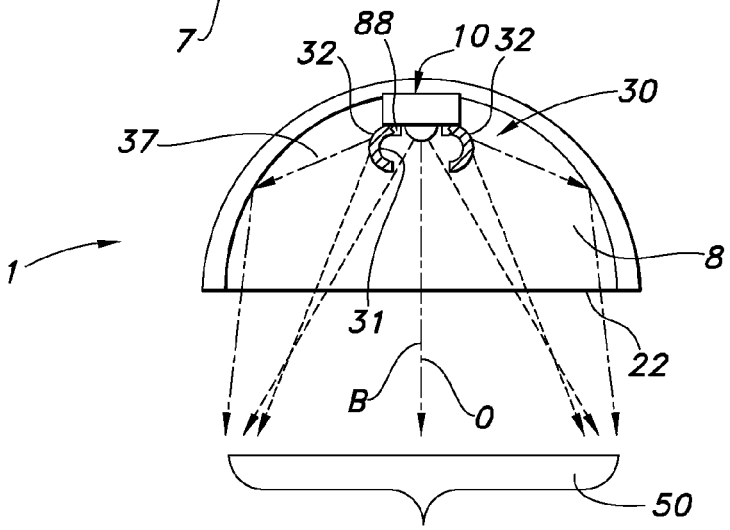

FIG. 1*k* schematically depicts an embodiment wherein the light conversion element 30 can be detachably attached to the lighting unit 1, for with connector(s), for instance attached with one or more screws, with one or more snap-on/snap-off means, a Velcro type of attachment, or may be attached via magnetic means. Here, a screw type of system is schematically depicted.

The invention claimed is:

1. A lighting unit comprising:

a light source configured to provide a beam of light, the light source having a light exit surface for escape of the light from the light source, a lamp shade partly surrounding the light source, wherein the lamp shade has an internal lamp shade surface and a lamp shade light exit, wherein the lamp shade light exit is the opening through which the light escapes from the lamp shade, a light conversion element, comprising luminescent material that has a hollow shape having a body axis and that is remote from said lamp shade, wherein the beam of light has an optical axis, wherein the body axis and optical axis coincide, the light conversion element being configured partly between the light exit surface of the light source and the lamp shade light exit of the lamp shade, thereby receiving part of the beam of light during operation of the lighting unit, wherein the light conversion element comprises a light transmissive part, wherein the light transmissive part comprises the luminescent material, wherein the light conversion element is an open structure with an opening disposed toward the lamp shade light exit and wherein the luminescent material is configured to convert at least part of the beam of light into luminescent material light for creating a colored appearance within the lamp shade.

2. The lighting unit according to claim 1, wherein the light transmission part comprises a plurality of transmissive regions having different luminescent properties.

3. Use of the lighting unit according to claim 2, for providing white lighting unit light escaping from the lamp shade light exit while creating a colored appearance within the lamp shade with different colored regions.

4. The lighting unit according to claim 1, wherein the light conversion element comprises a wall, wherein the wall comprises the light transmissive part, and wherein the wall further comprises one or more through holes.

5. The lighting unit according to claim 1, wherein the light conversion element comprises luminescent quantum dots.

6. The lighting unit according to claim 1, wherein the light conversion element comprises embedded micro particulate inorganic luminescent materials.

7. The lighting unit according to claim 1, wherein the light conversion element comprises embedded organic luminescent materials.

8. The lighting unit according to claim 1, wherein the light conversion element comprises embedded micro particulate organic luminescent materials.

9. The lighting unit according to claim 1, wherein the luminescent material comprises a perylene luminescent material.

10. The lighting unit according to claim 1, wherein the light source comprises a solid state LED light source.

11. The lighting unit according to claim 1, wherein the light conversion element is detachably attached to the lighting unit.

12. The lighting unit according to claim 1, wherein the light source is configured to provide light source light with a correlated color temperature in the range of 5000-20000 K.

13. The lighting unit according to claim 1, wherein said light conversion element is one of a plurality of light conversion elements, wherein said one of the plurality of light conversion elements is detachably attached to the lighting unit, wherein each light conversion element of the plurality of light conversion elements is readily attachable to and readily detachable from said lighting unit via a respective connector such that said one of the plurality of light conversion elements is readily replaceable with at least one other light conversion element of the plurality of light conversion elements.

14. The lighting unit according to claim 13, wherein said connector is at least one of one or more screws, one or more snap connectors, a hook and loop fastener, or a magnetic connector.

15. Use of the lighting unit according to claim 1, for providing white lighting unit light escaping from the lamp shade light exit while creating a colored appearance within the lamp shade.

16. The lighting unit according to claim 1, wherein said lighting unit is free of light conversion material along or about said optical axis.

17. The lighting unit according to claim 1, wherein said luminescent material comprises a first subsection configured to produce light of a first wavelength and to illuminate a first region on an inner surface of said lamp shade facing said light conversion element, and comprises a second subsection configured to produce light of a second wavelength and to illuminate a second region on the inner surface of said lamp shade such that said second region appears to have a different color than said first region when viewed by a user during operation of the lighting unit.

* * * * *